United States Patent [19]

Schaeffler

[11] Patent Number: 4,648,360

[45] Date of Patent: Mar. 10, 1987

[54] HYDRAULIC VALVE TAPPET

[75] Inventor: Georg Schaeffler, Herzogenaurach, Fed. Rep. of Germany

[73] Assignee: Motomak Motorenbau, Maschinen-und Werkzeugfabrik Konstruktionen GmbH, Fed. Rep. of Germany

[21] Appl. No.: 813,249

[22] Filed: Dec. 24, 1985

[30] Foreign Application Priority Data

Jan. 9, 1985 [DE] Fed. Rep. of Germany ..... 3500425

[51] Int. Cl.[4] ..... F01L 1/24

[52] U.S. Cl. ..... 123/90.55

[58] Field of Search ..... 123/90.55, 90.56, 90.57, 123/90.58, 90.59

[56] References Cited

U.S. PATENT DOCUMENTS

| | | | |
|---|---|---|---|
| 4,437,439 | 3/1984 | Speil | 123/90.55 |
| 4,465,038 | 8/1984 | Speil | 123/90.55 |
| 4,470,381 | 9/1984 | Buente et al. | 123/90.55 |

*Primary Examiner*—Ira S. Lazarus

*Attorney, Agent, or Firm*—Bierman and Muserlian

[57] ABSTRACT

In a hydraulic valve tappet arranged in a bore of a cylindrical guide bore of a cylinder head of an internal combustion engine comprising a cup shaped housing (1) comprising a hollow outer wall (2) closed at one end by an end member (3) and a cylindrical sleeve 4 bearing against it in its bore, the cylindrical sleeve changing into an annular element (5) near end member (3), the annular element (5) carrying in its bore a guide sleeve (6) running coaxially with the outer wall (2), an oil duct (7) formed in the longitudinal direction at a peripheral location between outer wall (2) and cylindrical sleeve (4) starting from an oil feed bore (8) in outer wall (2) and terminating in an annular outer oil reservoir (10) at the junction between cylindrical sleeve (4) and the annular element (5), the outer oil reservoir (10) being defined by end member (3) of housing (1), annular element (5) and a hydraulic compensating element (11) comprised of outer cylindrical element (12) longitudinally moveable in guide sleeve (4) and closed at its end away from end member (3) of housing (1) and provided in its bore with a piston element (13) longitudinally moveable with little play, the piston element (13) comprising a hollow cylindrical casing (14) provided with a partition (15) between its ends having a through bore (16) closed by a check valve (17) and one end thereof bears against the inner surface of end member (3) to define a central oil reservoir (18) extending in front of check valve (17) and its other end together with cylindrical element (12) defines a high pressure oil chamber (19) closed by check valve (17) and with a recess (20) serving as oil transfer opening provided at a peripheral location of the contact area of piston element (13) and end member (3) on the inner surface of member (3) overlapping the contact area, the improvement comprising that the opening (9) of oil duct (7) into the annular outer oil reservoir (10) and recess (20) on the inner surface of end member (3) are diametrically opposite each other.

2 Claims, 5 Drawing Figures

HYDRAULIC VALVE TAPPET

STATE OF THE ART

Figure 1:
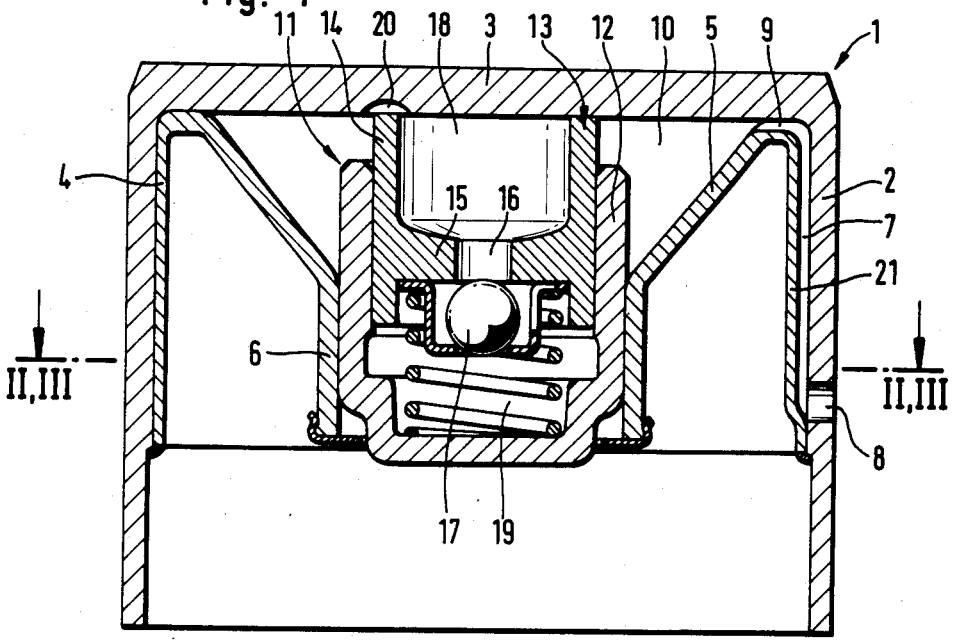

Hydraulic valve tappets arranged in a bore of a cylindrical guide bore of a cylinder head of an internal combustion engine comprising a cup shaped housing comprising a hollow outer wall closed at one end by an end member and a cylindrical sleeve bearing against it in its bore, the cylindrical sleeve changing into an annular element near end member, the annular element carrying in its bore a guide sleeve running coaxially with the outer wall, an oil duct formed in the longitudinal direction at a peripheral location between outer wall and cylindrical sleeve starting from an oil feed bore in outer wall and terminating in an annular outer oil reservoir at the junction between cylindrical sleeve and the annular element, the outer oil reservoir being defined by end member of housing, annular element and a hydraulic compensating element comprised of outer cylindrical element longitudinally moveable in guide sleeve and closed at its end away from end member of housing, and provided in its bore with a piston element longitudinally moveable with little play, the piston element comprising a hollow cylindrical casing provided with a partition between its ends having a through bore closed by a check valve and one end thereof bears against the inner surface of end member to define a central oil reservoir extending in front of check valve and its other end together with cylindrical element defines a high pressure oil chamber closed by check valve and with a recess serving as oil transfer opening provided at a peripheral location of the contact area of piston element and end member on the inner surface of member overlapping the contact area are known. In one valve tapped of this type, the opening of the oil duct in the annular outer oil reservoir and the recess provided on the inner surface of the end member are situated on the same side of the longitudinal axis of the valve tappet. This has no disadvantageous effect when the valve tappet is mounted with a vertical longitudinal axis. However, in modern engines, the tappets are very often installed in an inclined position and it must be assumed that after a lengthy stoppage during which the oil feed lines run empty, the reservoirs inside the tappet can also run empty. If, as in the known tappet, both the opening of the oil duct in the annular outer oil reservoir and the oil transfer opening between the outer and the central oil reservoirs are situated on the same side of the longitudinal axis of the tappet, there is the risk that these two oil reservoirs could at least partially run empty, especially when during the operation these openings could come to point downward due to unavoidable rotation of the valve tappet, and the engine is then stopped (DE-OS No. 3,006,644).

OBJECTS OF THE INVENTION

It is an object of the invention to achieve by a simple construction not entailing any additional manufacturing expense, that at least the central oil reservoir remains filled with oil in all instances.

This and other objects and advantages of the invention will become obvious from the following detailed description.

THE INVENTION

The invention achieves this goal by placing the opening of the oil duct into the annular outer oil reservoir and the recess provided on the inner surface of the end member diametrically opposite to each other. By this arrangement, the outer annular oil reservoir can at most run partially empty, but not the central oil reservoir, whose oil volume has the important task of being available to fill the high pressure oil chamber when the engine is restarted again.

Figure 2:
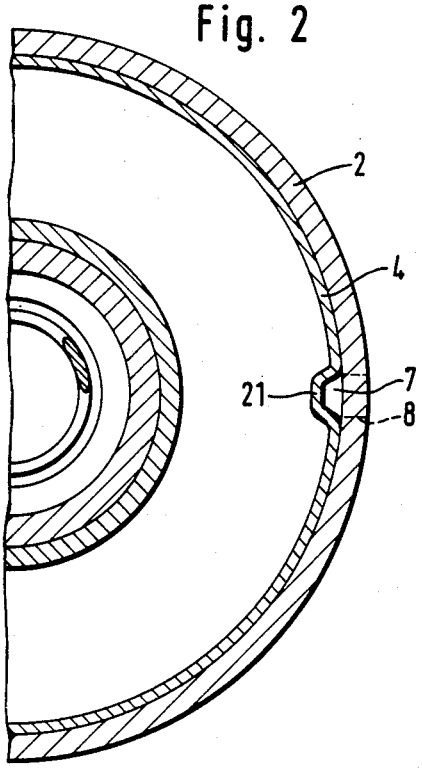
Figure 3:
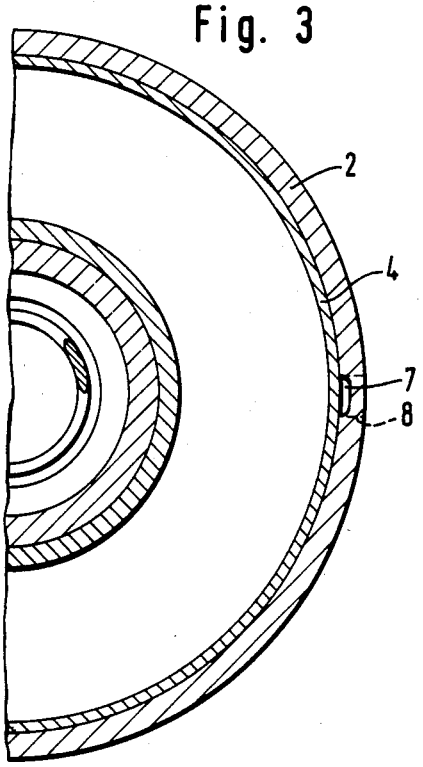
Figure 4:
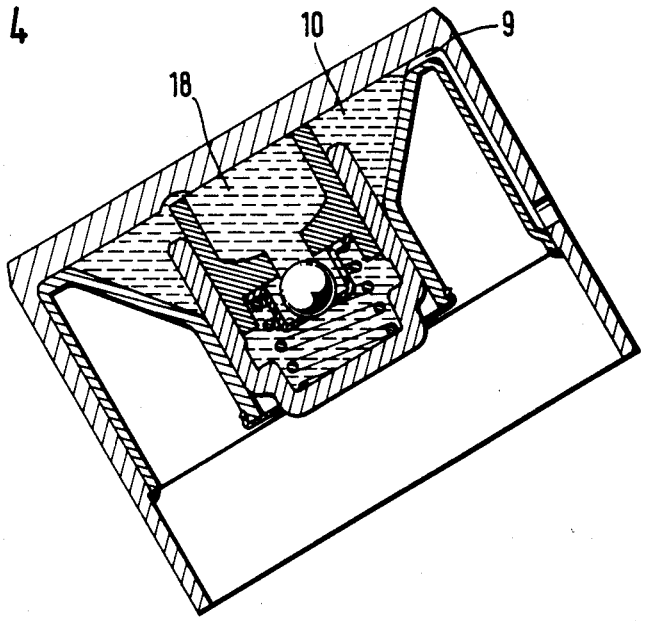
Figure 5:
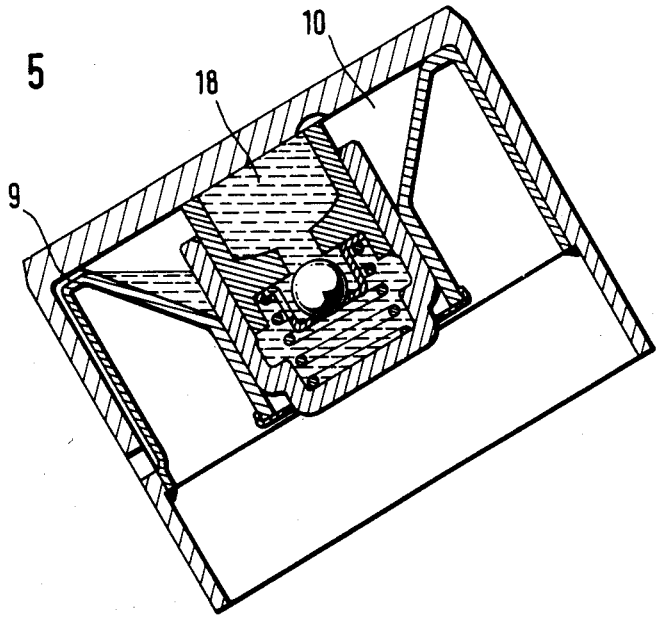

Referring now to the drawings:

FIG. 1 is a longitudinal cross-section through a valve tappet of the invention, FIGS. 2 and 3 are cross-sections taken along lines II, III—II, III of FIG. 1, FIGS. 4 and 5 are longitudinal cross-sections through inclined valve tappets in various positions.

The valve tappet of FIG. 1 is comprised of cup shaped housing 1 having a cylindrical outer wall 2 that is closed at one end by an end member 3. A cylindrical sleeve 4 bears against the bore of outer wall 2, which cylindrical sleeve 4 changes into a funnel-shaped annular element 5 which in its bore carries a guide sleeve 6 running coaxially with outer wall 2. At a peripheral point between outer wall 2 and cylindrical sleeve 4, a longitudinally running oil duct 7 is formed which starts from an oil feed bore 8 provided in outer wall 2 and which at the junction point from cylindrical sleeve 4 to annular element 5 has an opening 9 leading to an annular outer oil reservoir 10 that is defined by end member 3, annular element 5 and hydraulic play compensating element 11 which is comprised of outer cylinder element 12 that is moveable longitudinally in guide sleeve 6 which is closed at its end that is away from end member 3 of housing 1, and which in its bore has a piston element 13 that is longitudinally moveable with little play. Said piston part 13 is comprised of a hollow cylindrical casing 14 which has a partition 15 with a through bore 16 that is closed by a ball check valve 17 between its ends, and which with one of its ends bears against the inner surface of end member 3 of housing 1 to define a central oil reservoir extending in front of check valve 17. Its other end together with cylinder element 12 defines a high pressure oil chamber 19 that is closed by check valve 17. To permit passage of oil from the annular outer oil reservoir 10 to the central oil reservoir 18, a recess 20 is provided at a peripheral point of the contact area between piston element 13 and the inner surface of end member 3 so that the said recess overlaps this contact area and is diametrically opposite opening 9.

FIGS. 2 and 3 show in partial sections different embodiment for forming oil duct 7. In FIG. 2, cylindrical sleeve 4 (as in FIG. 1) is provided at the corresponding peripheral point with a longitudinal reinforcing crease 21 which together with the cylindrical face of the bore of outer wall 2 defines oil duct 7. In contrast, FIG. 3 shows a variant in which cylindrical sleeve 4 is formed cylindrically in the area of oil duct 7 as well, while for forming duct 7 a longitudinal groove is incorporated in tubular outer wall 2 For attaching and sealing, cylindrical sleeve 4 can as shown in FIG. 1, be joined at its open end to cylindrical outer wall 2 by welding, soldering or similar means.

FIGS. 4 and 5, which show the valve tappet of FIG. 1 mounted in an inclined position and in different rotational positions, illustrate the effect of the measure of the invention. In FIG. 4, opening 9 is at the highest point and the result is that neither annular outer oil reservoir 10 nor central oil reservoir 18 can run empty.

Rather, both will remain completely filled with oil in this position, even if the engine should be stopped for a longer period of time. In the position of the valve tappet shown in FIG. 5, opening 9 is at its lowest point and this has the result that although annular outer oil reservoir 10 does run partially empty, as shown, central oil reservoir 18 remains filled with oil.

The object of the invention is attained not only when the opening of the oil duct and the recess provided in the end member face are exactly diametrically opposite each other, but also when their positions deviate more or less from the diametrical. Even if the opening of the oil duct and the recess provided in the bottom are at a 90° angle to each other, an effect is still obtained that is considerably superior to that obtained with the known state of the art.

Various modifications of the article of the invention may be made without departing from the spirit or scope thereof and it is to be understood that the invention is intended to be limited only as defined in the appended claims.

What I claim is:

1. In a hydraulic valve tappet arranged in a bore of a cylindrical guide bore of a cylinder head of an internal combustion engine comprising a cup shaped housing (1) comprising a hollow outer wall (2) closed at one end by an end member (3) and a cylindrical sleeve (4) bearing against it in its bore, the cylindrical sleeve changing into an annular element (5) near end member (3), the annular element (5) carrying in its bore a guide sleeve (6) running coaxially with the outer wall (2), an oil duct (7) formed in the longitudinal direction at a peripheral location between outer wall (2) and cylindrical sleeve (4) starting from an oil feed bore (8) in outer wall (2) and terminating in an annular outer oil reservoir (10) at the junction between cylindrical sleeve (4) and the annular element (5), the outer oil reservoir (10) being defined by end member (3) of housing (1), annular element (5) and a hydraulic compensating element (11) comprised of outer cylindrical element (12) longitudinally moveable in guide sleeve (4) and closed at its end away from end member (3) of housing (1), and provided in its bore with a piston element (13) longitudinally moveable with little play, the piston element (13) comprising a hollow cylindrical casing (14) provided with a partition (15) between its ends having a through bore (16) closed by a check valve (17) and one end thereof bears against the inner surface of end member (3) to define a central oil reservoir (18) extending in front of check valve (17) and its other end together with cylindrical element (12) defines a high pressure oil chamber 19 closed by check valve (17) and with a recess (20) serving as oil member opening provided at a peripheral location of the contact area of piston element (13) and end member (3) on the inner surface of member (3) overlapping the contact area, the improvement comprising that the opening (9) of oil duct (7) into the annular outer oil reservoir (10) and recess (20) on the inner surface of end member (3) are diametrically opposite each other.

2. The valve tappet of claim 1 wherein annular element (5) is funnel-shaped.

* * * * *